United States Patent [19]

Moore, Jr.

[11] Patent Number: 4,852,314

[45] Date of Patent: Aug. 1, 1989

[54] PREFABRICATED INSULATING AND VENTILATING PANEL

[76] Inventor: Thomas W. Moore, Jr., 2025 Sylvester Rd., Lakeland, Fla. 33801

[21] Appl. No.: 270,375

[22] Filed: Nov. 9, 1988

Related U.S. Application Data

[63] Continuation of Ser. No. 940,269, Dec. 11, 1986, abandoned.

[51] Int. Cl.[4] ..... E04H 12/28

[52] U.S. Cl. ..... 52/199; 52/95; 52/303

[58] Field of Search ..... 52/22, 95, 199, 303, 52/807, 898; 98/42.21

[56] References Cited

U.S. PATENT DOCUMENTS

| | | | |
|---|---|---|---|
| 1,028,725 | 6/1912 | Hodgson | 98/42.21 |
| 2,324,971 | 7/1943 | Woodward | 52/303 |
| 3,006,113 | 10/1961 | Barnes et al. | 52/95 X |
| 3,086,323 | 4/1963 | Pine | 52/22 |
| 3,295,278 | 1/1967 | Muhm | 52/233 |
| 3,595,728 | 6/1967 | Robson | 161/53 |
| 3,748,803 | 7/1973 | Widerby et al. | 52/303 |
| 3,756,895 | 9/1973 | Bellamy | 156/257 |
| 4,254,598 | 3/1981 | Rugrogen | 52/199 |
| 4,382,435 | 3/1983 | Brill-Edwards | 126/429 |
| 4,429,503 | 2/1984 | Holliday | 52/410 |
| 4,635,419 | 1/1987 | Forrest | 52/303 |

FOREIGN PATENT DOCUMENTS

| | | | |
|---|---|---|---|
| 1281133 | 10/1968 | Fed. Rep. of Germany | 52/22 |
| 7614608 | 7/1978 | Netherlands | 52/199 |
| 775258 | 10/1980 | U.S.S.R. | 52/199 |
| 1097452 | 1/1968 | United Kingdom | 52/22 |
| 1196469 | 6/1970 | United Kingdom | 52/22 |

OTHER PUBLICATIONS

Popular Science vol. 229, No. 4 Oct. 1986 p. 46.

*Primary Examiner*—David A. Scherbel
*Assistant Examiner*—Creighton Smith
*Attorney, Agent, or Firm*—Warren L. Franz

[57] ABSTRACT

A prefabricated insulating and ventilating panel used between the exterior covering and framing components of a roof or wall in building construction has a rectangular plywood or oriented strand board deck spaced above a rectangular substrate of rigid closed foam thermal insulating material to provide air passageways to relieve heat buildup that causes wear of asphalt shingles and other roofing or wall covering materials, An alternative form includes a rectangular plywood or oriented strand board underdeck attached in contact with and below the insulating substrate to serve as sheathing for direct attachment to the building frame.

16 Claims, 2 Drawing Sheets

PREFABRICATED INSULATING AND VENTILATING PANEL

This application is a continuation of application Ser. No. 940,269, filed Nov. 9, 1988 now abandoned.

This invention relates to a prefabricated insulating and ventilating panel for use between the exterior covering and framing components of a building construction.

BACKGROUND OF INVENTION

Typical exterior covering materials used in modern roof construction include asphalt, wood and mineral fiber shingles and shakes. Such roofing materials are applied to decking over the framing members of a building roof structure to provide waterproofing and to give protection of the underlying structure from adverse effects due to rain and other natural elements. Similar exterior covering can be applied to the outside walls of a building, as can other materials such as siding and the like. Aesthetic appearance of the exterior roofing or wall covering materials is important, and so is long life. Replacement is a labor intensive and, thus, expensive undertaking.

The life of roofing and wall covering materials is greatly reduced by the buildup of heat in the decking between the exterior covering and the underlying insulation. This is especially a problem in hot climates, such as those of Central and Southern Florida, in which the roofs and walls are constantly exposed to intensive heating from the sun. It is therefore advantageous to provide cooling ventilation between the decking and the underlying insulation. Such ventilation is also useful in colder climates where, for example, uneven roofing temperatures can contribute to the buildup of ice dams that help speed deterioration of the roofing.

Conventional roofs are typically constructed by attaching plywood or oriented strand board decking or other sheathing material to the rafters of the roof frame. Asphalt-saturated felt is then applied in layers over the sheathing, and roofing material (rolled, shingles, or shakes) is fastened row-over-row to the plywood or oriented strand board over the felt. Conventional wall construction is similar.

To prevent heat buildup under the roofing, the space beneath the sheathing should be well ventilated. This ventilation may be provided with louver vents or an exhaust fan in an attic, but is difficult to accommodate in open-beam roof constructions, such as cathedral ceilings, where batts or rigid insulation material is placed in direct contact with the sheathing.

One prior art approach to ventilating a pitched roof, described in U.S. Pat. No. 4,254,598, employs corrugated panels nailed between a base roof structure and an overlying decking to which the shingles or other roofing material are affixed. The spaces provided by the corrugations serve as air passages for the circulation of air between the base structure and the top decking, up the roof from the eaves to the ridge. The aim of the air passages is to keep the roofing material at uniform ambient temperature to prevent the formation of ice dams in winter and the buildup of heat in the summer.

The ventilating passages provided by the corrugated structure of U.S. Pat. No. 4,254,598 do not interconnect to allow cross-ventilation between adjacent passageways at points intermediate the eaves and ridge. Further, although local temperature variations are dispersed through air circulation, no insulation material is interposed between the roofing and the base roof structure to keep out the ambient temperature. Insulation needs must, thus, be separately addressed. Moreover, the corrugated panel must be affixed to the base structure and the overlying decking applied at the building site in a two step process. The bottom of each corrugation is first nailed to the base structure and then the overlying decking is nailed to the top of each corrugation. This on-site assembly process is time consuming and, when completed, leaves an array of nail heads and possibly protruding nails exposed on the surface to tear into the overlying roofing and othrwise interfere with the roof laying process.

SUMMARY OF THE INVENTION

It is an object of the present invention to overcome the above and other drawbacks of the prior art by providing a prefabricated insulating and ventilating panel for use between the exterior covering and framing components of a roof or outside wall in building construction.

In one aspect of the invention a rigid, unitary panel of composite structure is provided that is made up of a deck portion, suitable for attachment of roofing or wall covering material, superposed in fixed relationship above a substrate of thermal insulating material. Spacing is provided between the deck and the substrate to present an intermediate passageway for the flow of ventilating air through the panel between the deck and the substrate.

In another aspect of the invention, a plurality of spacing elements serve to secure the deck to the substrate and define the spacing therebetween. The spacing elements are set in laterally separated positions away from the edges of the panel so as to present a plurality of interconnecting channels through the panel.

In a preferred embodiment, described in greater detail below, a prefabricated insulating and ventilating panel in accordance with the invention comprises a rectangular sheet of wooden or other nailable material set in edge-to-edge alignment above a rectangular sheet of rigid insulation material. Furring strips are attached between the deck and insulating material to define the spacing of the sheets and are separated from each other in parallel centered positions running widthwise of the sheets, to present a plurality of parallel ventilating air channels running widthwise through the sheets, and interconnecting near the long edges of the panel.

In an alternative embodiment, a prefabricated insulating and ventilating panel includes an underdecking portion superposed in direct contact under the insulating substrate.

BRIEF DESCRIPTION OF THE DRAWINGS

Embodiments of the invention have been chosen for purposes of illustration and description, and are shown in the accompanying drawings, wherein.

Throughout the drawings, like elements are referred to by like numerals.

DESCRIPTION OF THE PREFERRED EMBODIMENTS

Figure 1:
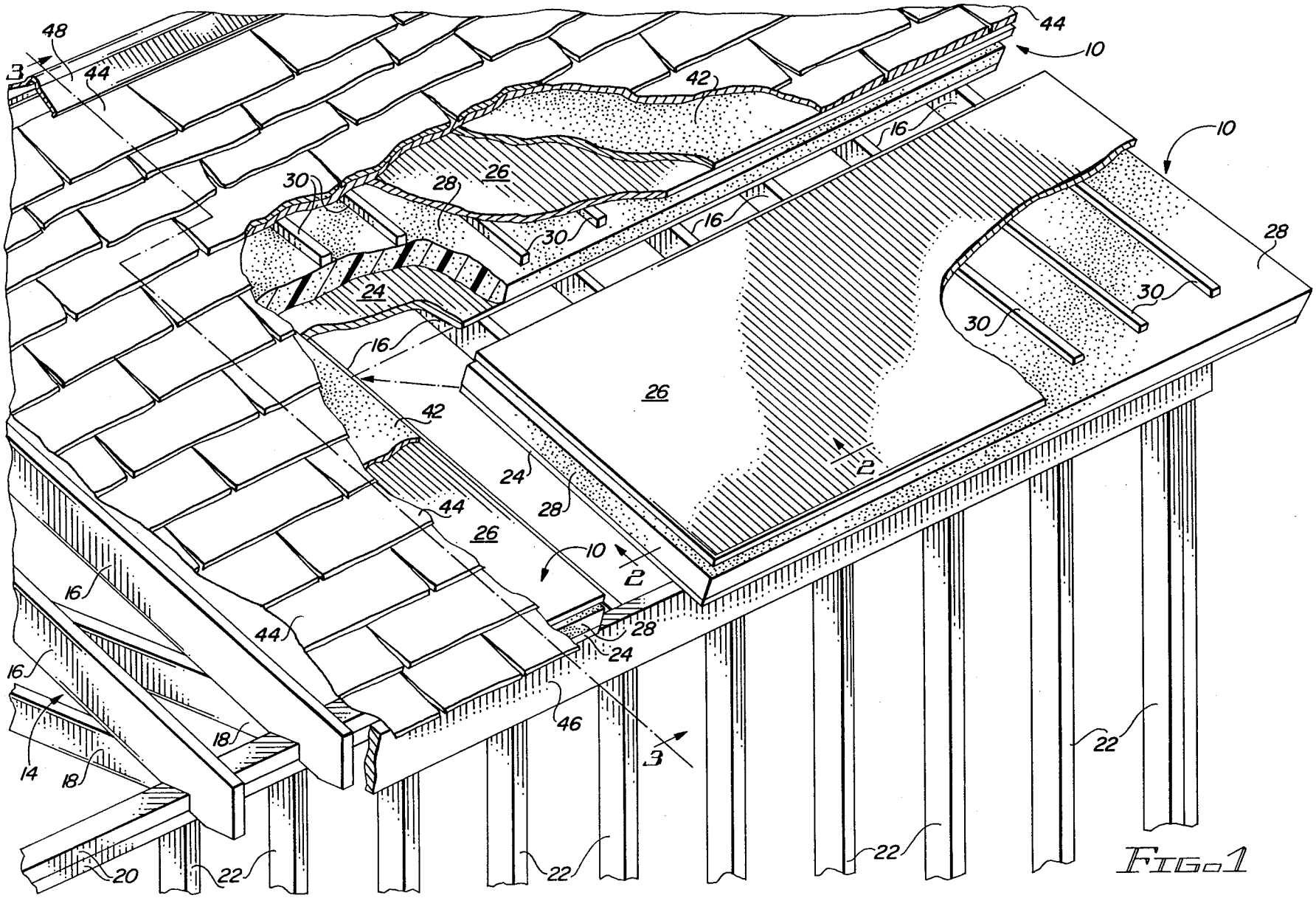
FIG. 1 is a partial perspective view, with portions removed, of a roof construction utilizing prefabricated insulating and ventilating panels in accordance with the present invention.
Figure 2:
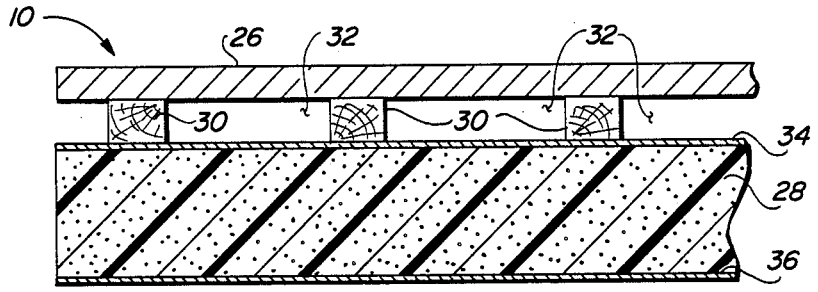
FIG. 2 is a section view taken along the line 2—2 of a panel of FIG. 1.
Figure 3:
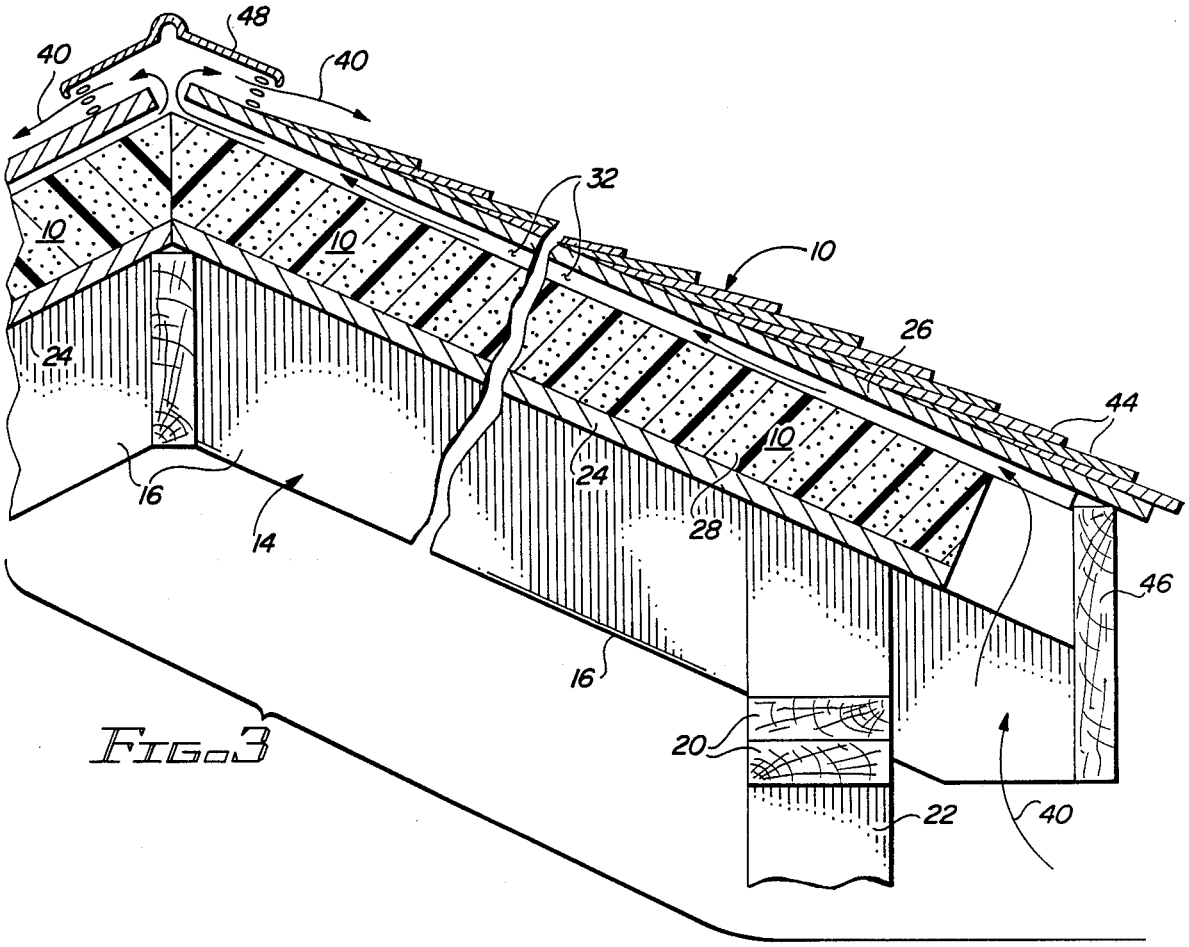
FIG. 3 is a view taken along the line 3—3 of FIG. 1, with the insulation cut back at the eaves and fascia board added; and, FIG. 4 is a view similar to FIG. 2 of a modified form of panel.

As shown in FIGS. 1–3, a plurality of prefabricated insulating and ventilating panels 10 is shown utilized between the roofing 12 and roof framing structure 14 of a building roof.

The roof framing 14 is assembled in a conventional manner with rafters 16 and joists 18 joining top plates 20 positioned above wall studs 22. A sheathing material, such as plywood or oriented strand board sheathing 24, is nailed securely to the rafters 16 to form an underdecking over which the panels 10 are laid. The configuration of framing structure 14 and the underdecking 24 is chosen to meet the particular needs of the shape and type roof desired. The framing 14 could, for example, take a non-pitched form of flat roof utilizing a frame structure 14 without rafters, and the underdecking 24 could take the form of spaced strips, such as slat sheathing, or be of some other material, e.g., metal.

The prefabricated panels 10 are rigid, unitary panels of composite construction (FIG. 3) made up of a deck portion 26 superposed in fixed relationship above a substrate 28 of thermal insulating material. A plurality of spacing elements 30 is secured between the deck 26 and substrate 28 to define the spacing therebetween. The spacing provides an intermediate passageway 32 between the deck 26 and the substrate 28 for the flow of ventilating air through the panel 10.

Advantageously, the deck 26 and substrate 28 are rectangular-shaped sheets of rigid material superposed in spaced edge-over-edge relationship. For general acceptance throughout the roofing industry, a 4 ft.×8 ft. or other standard sized sheet is preferable. The decking 26 can be any rigid substance that has an upper surface suitable for the attachment of roofing materials. A wooden nailable material, such as plywood or oriented strand board, is satisfactory. The material for substrate 28 is chosen based on its rigidity, ease of attachment to the underdecking 24 and its R-value insulating characteristics. a rigid self-supporting closed foam insulating material, such as a rigid thermally efficient extruded phenolic foam board having a 25-lb. compressive strength, is suitable. The insulating material board may be provided with upper and/or lower fiberglass facers 34, 36, that might serve little purpose in a closed foam insulating board but which may desirably impart moisture impermeability and breakup protection to open foam or other types of insulating material. Although not this inventor's choice because it adds complexity to an otherwise simple unitary structure, substrate 28 can also be formed using a non-rigid insulating material by containing the insulation in a rigid enclosure.

The spacers 30 (FIG. 2) serve the purpose of securing the deck 26 to the substrate 28 and to create the spacing that forms the ventilating passageways 32 of the panel 10. In their preferred configuration, the spacing elements 30 are set between the deck 26 and substrate 28 in laterally separated positions away friom the edges of the panel 10 to present a plurality of interconnecting adjacent channels 38 through the panel 10 (FIG. 1). As shown in the exemplary embodiment of FIG. 1, spacers taking the form of furring strips 30 are attached between the decks 26 and substrates 28 of the panels 10 is centered positions running widthwise of rectangular sheets 26 and 28, thereby presenting a plurality of parallel air channels 38 running widthwise of the panel 10. As seen in FIG. 1, stopping the furring strips short of the edges of the panels 10 permits air to flow, not only through aligned channels 38 from one panel 10 to another, but also between non-aligned channels 38. This is illustrated in FIG. 1 by the arrow 40. As shown, the positioning of the strips 30 inwardly of the panel edges presents an unobstructed marginal edge border between the deck 26 and substrate 28 of each panel 10.

The preferred panel 10 has a rectangular plywood or oriented strand board deck portion 26, a rectangular phenolic board substrate 28 and plywood or oriented strand board furring strips 30. Secure connection of the plywood or oriented strand board strips 30 to the deck 26 and substrate 28 is achieved by means of an adhesive, such as Borden's Construction Adhesive 100. It is recognized that other suitable material exists for use as the spacers 30. So, the means for securing the spacers 30 to the deck 26 and substrate 28 should, thus, be varied accordingly.

The panels 10 are laid in adjacent positions over the underdecking 24 on top of the roof framing 14 with the insulating substrate 28 flush against the sheathing 24 (FIG. 1). For the preferred OSB-phenolic composition of panel 10, the panels 10 can be secured to the underdecking 24 by nails. One or more layers of asphalt-saturated felt 42 are then laid down over the exposed deck portions 26 of the mounted panels 10. Roofing 44 is then secured over the felt layers 42 to the panel 10. The choice of roofing 44 is made based on the needs of the building and on individual builder preference. FIG. 1 shows the application of asphalt shingles 44 of the standard three-tab design in conventional row-over-row placement over the deck portions 26 of the panels 10.

FIG. 3 shows a cross-sectional view of the finished roof with asphalt shingles 44 in place. A fascia board 46 has been added and the underdecking 24 and insulation 28 is shown cut back from the board 46 to permit air to flow from below the eaves to the passageways 32 of the panels 10. In a pitched roof construction, as illustrated by arrows 40 in FIGS. 1 and 3, air will move by convection up from the eaves, through the passageways 32, and exit at the roof ridge through a ridge vent cap 48. To achieve similar air flow in flat roof constructions and to augment convective air flow, mechanical fans (not shown) may be provided.

Instead of cutting the insulation 28 back as shown in FIG. 3, it will be appreciated that other avenues of access to the passageways 32 can be provided. For example, holes can be cut through the substrate insulation 28 at appropriate locations and screened openings can be provided therein. The phenolic insulation board is readily cuttable and will thus accommodate a wide variety of venting schemes. It is not necessary to cut the deck portion 26 of the panel 10 which lies above the passageway 32.

Figure 4:
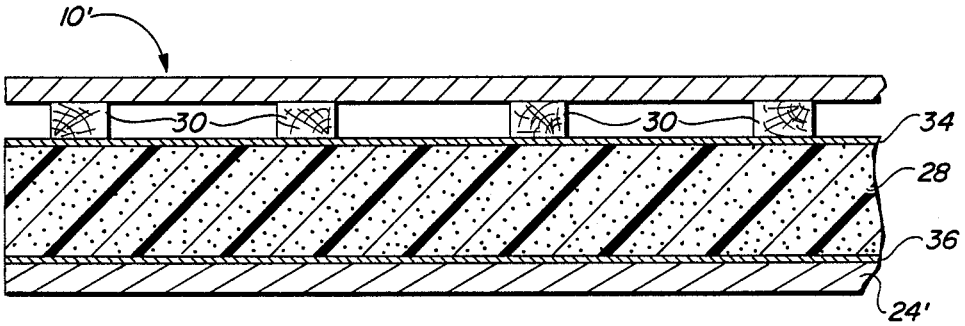

FIG. 4 shows an alternative embodiment of panel 10' wherein a layer of sheathing material 24' is incorporated in the panel 10' below and in contact with the substrate 28 of insulating material. This modified panel 10' is suitable for application directly to the framing components 14, such as rafters 16 of FIG. 1, without the necessity to apply a separate underdecking 24. The preferred material for the integral underdecking portion 24' is plywood or oriented strand board.

The foregoing detailed description illustrates the benefits to be achieved by panels 10 and 10' according to the invention. Application of the panels 10 and 10' for wall insulation and ventilation is similarly achieved. The invention provides an easily useable prefabricated building element for use in roof or wall construction that not only insulates the underlying structure from ambient temperature but ventilates the asphalt shingles or other exterior covering material.

Those skilled in the art to which the invention relates will appreciate that various other substitutions and modifications may be made to the panel described above, without departing from the spirit and scope of the present invention as defined by the claims appended hereto.

What is claimed is:

1. A prefabricated insulating and ventilating panel for use between the exterior covering and framing components of a roof or outside wall in building construction, said panel having edges and comprising a rigid, unitary structure having:

a deck portion, including an outer surface suitable for attachment of exterior covering materials, and an inner surface;

a substrate of rigid, thermal insulating material including an outer surface; and a plurality of spacing elements set between said inner surface of said deck portion and said outer surface of said substrate in laterally separated positions inwardly of the edges of the panel, said spacing elements securing said deck portion in fixed, spaced, superposed relationship above said substrate to present an unobstructed marginal edge air channel circumferentially around said panel and a plurality of adjacent interconnecting channels for the flow of ventilating air through the panel between said deck portion and said substrate, and among said channels.

2. A panel as in claim 1, wherein said deck portion comprises a first rectangular sheet; wherein said substrate comprises a second rectangular sheet set in edge-to-edge alignment below said first sheet; and wherein said spacing elements comprise furring strips attached between said first and second sheets in separated centered positions running widthwise of the sheets, to present a plurality of parallel air channels, running widthwise through the sheets and interconnecting with each other near the long edges of the sheets.

3. A panel as in claim 2, wherein said deck portion sheet and furring strips comprise wood; and wherein said substrate sheet comprises a sheet of rigid foam insulation material.

4. A panel as in claim 3, wherein said wood is plywood or oriented strand board and said insulation is a closed foam phenolic material.

5. A panel as in claim 1, wherein said rigid, unitary structure further comprises an underdecking portion attached below and in contact with said substrate and being suitable for direct attachment to the building framing components.

6. A prefabricated insulating and ventilating panel for use between the roofing and framing components of a roof in building construction, comprising a rigid, integral structure having:

a generally planar substrate of rigid insulating material and including an outer surface having edges;

a generally planar deck of rigid nailable material superposed over said substrate and including an inner surface having edges; and a plurality of elongated spacers secured between said outer surface of said substrate and said inner surface of said deck, and serving to define the spacing therebetween, said spacers being positioned inwardly of the edges of the surfaces to present unobstructed marginal edge air channel between said substrate and said deck at least adjacent the ends of said spacers, and said spacers being separated from each other to present a plurality of adjacent interconnecting channels for the flow of ventilating air through the panel between said substrate and said deck, and among said channels.

7. A panel as in claim 6, further comprising a moisture impermeable facing on said insulating material.

8. A panel as in claim 6, wherein said substrate is a sheet of rigid foam insulating material; said deck is a sheet of wooden material set in edge-to-edge alignment above said sheet of rigid foam insulating material; and said spacers are furring strips secured in parallel positions inwardly of said aligned edges between said sheets to present interconnecting parallel airflow channels.

9. A panel as in claim 8, wherein said insulating material is a phenolic foam; and wherein said wooden material is plywood or oriented strand board.

10. A panel as in claim 8, wherein said substrate and deck sheets are rectangular sheets; and wherein said furring strips are evenly separated and run in widthwise-centered positions widthwise between the sheets.

11. A panel as in claim 6, wherein said integrated structure further comprises a generally planar underdeck of rigid nailable material attached below and in contact with said substrate.

12. A roof construction for a building, comprising:

a framing structure;

a plurality of prefabricated insulating and ventilating panels attached to said framing structure, each panel comprising a rigid, integral structure having:

a rectangular sheet of rigid insulating material and including an outer surface;

a rectangular sheet of rigid nailable material superposed in edge-to-edge alignment above said sheet of insulating material and including an inner surface; and a plurality of furring strips secured in parallel positions inwardly of said aligned edges between said outer and inner surfaces of said sheets, and serving to define the spacing between said sheets, said strips being separated from each other and being positioned inwardly of the aligned edges of the sheets to present a plurality of adjacent interconnecting parallel channels for the flow of air through said panels between said sheets and among said channels, and to present an unobstructed marginal edge air channel between said sheets at least adjacent the ends of said strips; and a quantity of roofing nailed to the sheets of nailable material.

13. A pitched-roof construction, comprising a roof construction as in claim 12, wherein said framing structure further comprises eaves and a ridge; and wherein said furring strips are arranged and said panels are attached to said framing structure to present a plurality of interconnecting parallel channels for the convective flow of air through said panels from said eaves to said ridge.

14. A roof as in claim 13, wherein said furring strips of each panel are evenly separated and run in widthwise-centered positions widthwise between the sheets; and wherein said panels are attached to said framing structure with the furring strips running perpendicular to said ridge.

15. A roof as in claim 12, wherein said rigid insulating material is a phenolic foam and wherein said nailable material is plywood or oriented strand board.

16. A roof as in claim 12, wherein the integral structure of each panel further comprises a rectangular sheet of rigid nailable material attached in edge-to-edge alignment below and in contact with said sheet of insulating material.

* * * * *